US010133216B2

(12) United States Patent
Honya et al.

(10) Patent No.: US 10,133,216 B2
(45) **Date of Patent: *Nov. 20, 2018**

(54) INTERMEDIATE TRANSFER MEMBER AND IMAGE FORMING APPARATUS HAVING THE SAME

(71) Applicant: Konica Minolta, Inc., Tokyo (JP)

(72) Inventors: Akihiro Honya, Musashino (JP); Shinichi Hamaguchi, Hino (JP); Shinichi Yabuki, Sagamihara (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/461,030

(22) Filed: Mar. 16, 2017

(65) Prior Publication Data

US 2017/0285533 A1 Oct. 5, 2017

(30) Foreign Application Priority Data

Apr. 1, 2016 (JP) ..... 2016-074628

(51) Int. Cl.
*G03G 15/16* (2006.01)

(52) U.S. Cl.
CPC ..... *G03G 15/162* (2013.01)

(58) Field of Classification Search
CPC ..... G03G 15/162
See application file for complete search history.

(56) References Cited

U.S. PATENT DOCUMENTS

| | | | | |
|---|---|---|---|---|
| 9,400,457 | B1 * | 7/2016 | Honya | G03G 15/162 |
| 2007/0188585 | A1 * | 8/2007 | Mochizuki | G03G 15/1625 347/140 |
| 2014/0038094 | A1 * | 2/2014 | Hamaguchi | G03G 5/142 430/64 |

FOREIGN PATENT DOCUMENTS

JP 2007183401 A 7/2007

OTHER PUBLICATIONS

Sartomer, SR454HP Product Bulletin, Sep. 2012, p. 1.*

* cited by examiner

*Primary Examiner* — Robert S Jones
(74) *Attorney, Agent, or Firm* — Lucas & Mercanti, LLP

(57) ABSTRACT

An intermediate transfer member includes a resin substrate layer and a surface layer containing a cured product of a composition including a specific polyfunctional (meth) acrylic monomer and a specific fine particle of metal oxide.

8 Claims, 6 Drawing Sheets

(A)

INTERMEDIATE TRANSFER MEMBER AND IMAGE FORMING APPARATUS HAVING THE SAME

CROSS-REFERENCE TO RELATED APPLICATION

This application is based on Japanese Patent Application No. 2016-074628 filed on Apr. 1, 2016, the contents of which are incorporated herein by reference.

BACKGROUND

1. Technical Field

The present invention relates to an intermediate transfer member and an image forming apparatus having the same.

2. Description of Related Art

In an electrophotographic image forming apparatus, for example, a latent image formed on an image carrier (photosensitive member) is developed with toner, the obtained toner image is temporarily held on a transfer member (intermediate transfer member) in a shape of an endless belt, and the toner image on this intermediate transfer member is transferred onto a recording medium such as paper. In addition, to improve the cleaning property or transfer function of a toner, the intermediate transfer member is required to have high durability.

As an intermediate transfer member like the above, an intermediate transfer member having a surface layer formed on a resin substrate layer has been suggested. For example, in JP 2007-183401A, an intermediate transfer belt having a resin cured film, which contains fine particle of metal oxide as conductive filler, on a base layer containing a thermoplastic resin is disclosed.

However, even when the intermediate transfer belt disclosed in JP 2007-183401A is used, the durability is insufficient, and thus it cannot be said that the cleaning property or transfer function of the toner is sufficient.

Furthermore, for the purpose of improving the durability, even when the hardness of a surface layer is simply increased by a method like increasing the number of functional groups of a monomer to be used or reducing the molecular weight of a monomer or the like, there is a problem that cracks easily occur on the surface layer so that the intermediate transfer member is broken depending on the case.

Accordingly, an objective of the present invention is to provide an intermediate transfer member which can suppress an occurrence of cracks and to improve the cleaning property and transfer function of a toner.

SUMMARY

To achieve the abovementioned object, an intermediate transfer member reflecting one aspect of the present invention comprises: an intermediate transfer member used for an electrophotographic image forming apparatus, wherein the intermediate transfer member has a resin substrate layer and a surface layer comprising a cured product of a composition containing a polyfunctional (meth)acrylic monomer and a fine particle of metal oxide, the polyfunctional (meth)acrylic monomer contains a number of alkylene oxide structure and b number of (meth)acryloyl group (with the proviso that a and b are a positive integer), a and b satisfy relationships of $a/b \leq 10$ and $b \geq 3$, the alkylene oxide structure contains an alkylene group with a carbon atom number of 2 or more, and the fine particle of metal oxide has on its surface a structure represented by a following General Formula (1):

$$CH_2{=}C(R)COO(CH_2)_nSi{-} \qquad \text{General Formula (1)}$$

in the formula, R represents a hydrogen atom or a methyl group, and n is an integer of from 7 to 17, and the present invention is completed accordingly.

DETAILED DESCRIPTION

<Intermediate Transfer Member>

Figure 1:
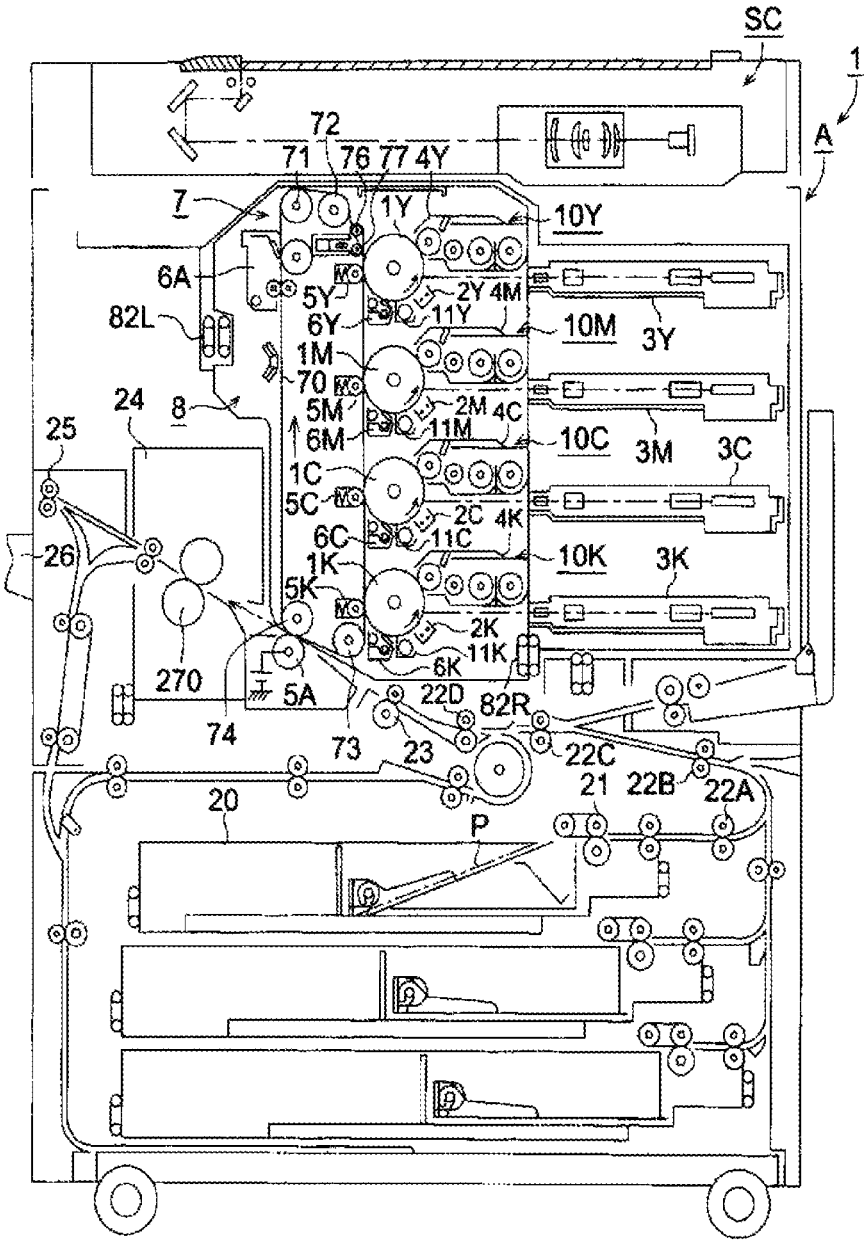
FIG. 1 is a diagram schematically illustrating one example of a constitution of a color image forming apparatus to which an intermediate transfer member of the present invention is mounted.

According to one embodiment of the present invention, provided is an intermediate transfer member used for an electrophotographic image forming apparatus, in which the intermediate transfer member is an intermediate transfer member used for an electrophotographic image forming apparatus and has a resin substrate layer and a surface layer including a cured product of a composition containing a polyfunctional (meth)acrylic monomer and a fine particle of metal oxide, the polyfunctional (meth)acrylic monomer contains a number of alkylene oxide structure and b number of (meth)acryloyl group (with the proviso that a and b are a positive integer), a and b satisfy relationships of $a/b \leq 10$ and $b \geq 3$, the alkylene oxide structure contains an alkylene group with a carbon atom number of 2 or more, and the fine particle of metal oxide has on its surface a structure represented by the following General Formula (1):

$$CH_2{=}C(R)COO(CH_2)_nSi{-} \qquad \text{General Formula (1)}$$

In the formula, R represents a hydrogen atom or a methyl group, and n is an integer of from 7 to 17.

According to the intermediate transfer member of the present invention, as the surface layer includes a cured product of a composition containing the polyfunctional (meth)acrylic monomer and fine particle of metal oxide, an occurrence of cracks on the surface layer can be suppressed and also the cleaning property and transfer function of a toner can be improved. Herein, although the mechanism for exhibiting the above working effect based on the constitution of the present invention remains not completely clear, according to curing a composition containing the polyfunctional (meth)acrylic monomer in which a and b satisfy the above relationships and fine particle of metal oxide which has on its surface the structure represented by the above General Formula (1), the polyfunctional (meth)acrylic monomer and the surface of the fine particle of metal oxide which has a structure represented by the above General Formula (1) are chemically bonded to each other so that the surface layer can have a molecular structure of which chain length is somewhat long. As this molecular structure with long chain length is present on the surface layer, when an intermediate transfer member is used as an intermediate transfer belt or a transfer fixing belt, it can follow the deformation even if the belt is deformed according to operation. Namely, it is considered that, as the degree of freedom of a belt for deformation (that is, flexibility of belt) is improved, an occurrence of cracks on the surface layer can be suppressed. Furthermore, the polyfunctional (meth) acrylic monomer in which a and b satisfy the above relationships can improve the flexibility of a belt, and as the end of the functional group of the polyfunctional (meth)acrylic monomer maintains certain distance from the main skeleton, the end of the functional group has higher degree of freedom in movement as a molecular structure so that it can effectively form a three-dimensional cross-linked structure. As such, it is considered that, by using in combination the polyfunctional (meth)acrylic monomer in which a and b satisfy the above relationships and the fine particle of metal oxide which has on its surface a structure represented by the above General Formula (1), cracks occurring on the surface layer can be sufficiently suppressed and the cleaning property and transfer function of a toner can be further improved. Meanwhile, it is evident that the present invention shall not be construed as being limited by the mechanism in any ways.

Hereinbelow, the intermediate transfer member as a preferred embodiment of the present invention is explained. The present invention is not limited to the following embodiments. Furthermore, the size ratio of the drawings is exaggerated for convenience, and it may be different from the actual ratio.

Furthermore, in the present specification, "X to Y" indicating a range means "X or more and Y or less". Furthermore, unless specifically described otherwise, the operations, physical properties, or the like are measured at conditions of room temperature (from 20 to 25° C.)/relative humidity of from 40 to 50% RH.

Furthermore, as described herein, the "(meth)acryl monomer" indicates an "acryl monomer" or a "methacryl monomer", the "(meth)acryloxy" indicates "acryloxy" or "methacryloxy", and the "(meth)acryloyl group" indicates an "acryloyl group" or a "methacryloyl group."

[Resin Substrate Layer]

The resin substrate layer according to the present invention contains a resin and a conductive filler.

Thickness of the resin substrate layer is preferably from 30 to 140 μm, and more preferably from 50 to 130 μm.

(Resin)

The resin used for the resin substrate layer is not particularly limited, and various kinds of a resin can be used. Examples of the resin include a resin having a structural unit with benzene ring such as polyphenylene sulfide (PPS), aromatic polyamideimide (PAI), aromatic polyether ether ketone (PEEK), aromatic polyimide (PI), aromatic polycarbonate or aromatic polyether ketone, polyvinylidene fluoride, or a mixture or a copolymer thereof. Among them, from the viewpoint of flame retardancy, strength, and durability, it is preferable to use a resin having a structural unit with benzene ring. In addition, from the viewpoint of cost related to production, it is more preferably polyphenylene sulfide (PPS).

(Conductive Filler)

Examples of the conductive filler include a conductive carbonaceous material such as carbon black or graphite; metal or alloy such as aluminum or copper alloy; and conductive metal oxide such as tin oxide, zinc oxide, antimony oxide, indium oxide, potassium titanate, antimony oxide-tin oxide composite oxide (ATO), or indium oxide-tin oxide composite oxide (ITO). The conductive filler may be used either singly or in combination of 2 or more members. As for the conductive filler, a conductive carbonaceous material is preferable, and carbon black is more preferable. The carbon black may be the one of which surface has been subjected to an oxidation treatment.

An addition amount of the conductive filler is in general, relative to 100 parts by mass of the resin, preferably from 4 to 40 parts by mass, and more preferably from 10 to 30 parts by mass. Accordingly, the resin substrate layer can be provided with a conductive property that is suitable for an intermediate transfer member.

(Other Materials)

The resin substrate layer may contain other materials, if necessary. Examples of the other materials include a dispersing agent and a lubricating material.

The dispersing agent is not particularly limited as long as the effect of the present invention is not impaired by it. When PPS or PEEK is used as a resin, for example, the dispersing agent is preferably ethylene glycidyl methacrylate-acrylonitrile styrene copolymer from the viewpoint of the compatibility with the resin and dispersion property of a conductive filler.

The addition amount of the dispersing agent is in general, relative to 100 parts by mass of the resin, preferably from 0.1 to 10 parts by mass, and more preferably from 0.5 to 5 parts by mass.

Examples of the lubricating material include aliphatic hydrocarbons such as paraffin wax or polyolefin wax, and higher fatty acid such as lauric acid, myrisitic acid, plamitic acid, stearic acid, behenic acid, or montanic acid, and a metal salt thereof. The lubricating material can be used either singly or in combination of 2 or more members.

According to a preferred embodiment of the present invention, for a case in which polyphenylene sulfide is used as the resin, the lubricating material is calcium montanate from the viewpoint of improving the molding processability.

The addition amount of the lubricating material is in general, relative to 100 parts by mass of the resin, preferably from 0.1 to 0.5 part by mass, and more preferably from 0.1 to 0.3 part by mass.

[Surface Layer]

The surface layer according to the present invention includes a cured product of a composition which contains the polyfunctional (meth)acrylic monomer and fine particle of metal oxide. The composition may contain other components within a range in which the effect of the present invention is not impaired by them. Examples of the other components include a solvent and a polymerization initiator.

Thickness of the surface layer is, although not particularly limited, preferably from 0.5 to 15 μm, more preferably from 1 to 13 μm, and even more preferably from 2 to 10 μm considering the function of an intermediate transfer member allowing a flexible response to thickness of a recording medium like paper. When the thickness of the surface layer is 0.5 μm or more, the durability of the surface layer can be enhanced. When the thickness of the surface layer is 15 μm or less, the flexibility of the surface layer can be maintained.

Hereinbelow, explanations are given for the polyfunctional (meth)acrylic monomer, fine particle of metal oxide, solvent, and polymerization initiator.

(Polyfunctional(Meth)Acrylic Monomer)

The polyfunctional (meth)acrylic monomer contains "a" number of alkylene oxide structure and "b" number of (meth)acryloyl group (with the proviso that a and b are a positive integer), in which a and b satisfy relationships of a/b≤10 and b≥3, and the alkylene oxide structure contains an alkylene group with a carbon atom number of 2 or more. "a" is not particularly limited as long as it satisfies the above relationship. "b" is preferably 10 or less, and more preferably 6 or less.

In the case of a/b>10, the molecular weight of the monomer is excessively high so that a dense cross-linking structure cannot be formed, and thus the abrasion resistance or hardness is impaired. In the case of b<3, it is difficult for a three-dimensional cross-linking structure to be formed, and thus the abrasion resistance or hardness is impaired. Furthermore, when the carbon atom number of the alkylene group is 1, the reactivity of the monomer is not sufficient.

According to a preferred embodiment of the present invention, the a/b preferably satisfies relationship of a/b≤3 from the viewpoint of the cleaning property and transfer function.

According to a preferred embodiment of the present invention, the carbon atom number of the alkylene group of the polyfunctional (meth)acrylic monomer is from 2 to 5 from the viewpoint of the durability and reactivity of the monomer.

The functional group equivalent weight ((meth)acrylic group equivalent weight) of the polyfunctional (meth) acrylic monomer is not particularly limited as long as the effect of the present invention is impaired by it. However, to obtain desired hardness that is suitable for an intermediate transfer member, it is preferably from 100 to 300. From the viewpoint of cleaning property and transfer ratio, the functional group equivalent weight is more preferably from 130 to 250.

Examples of the polyfunctional (meth)acrylic monomer include a compound which is represented by the following chemical formulae (1) to (19). Incidentally, R in the following chemical formulae represents an acryloyl group or a methacryloyl group.

(1)

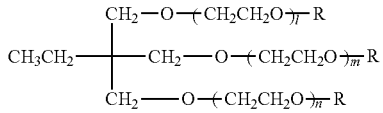

(2)

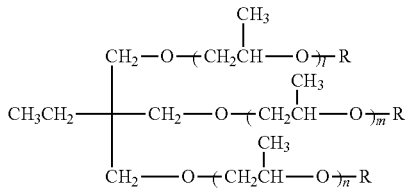

(3)

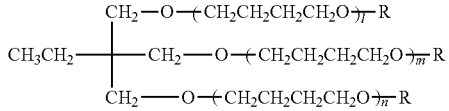

(4)

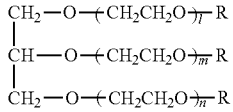

(5)

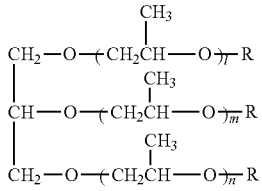

With regard to the compound represented by the chemical formulae (1) to (5), l, m, and n are an integer of 0 or more, and 1≤l+m+n≤30. Furthermore, in the compound, a=l+m+n, and b=3.

(6)

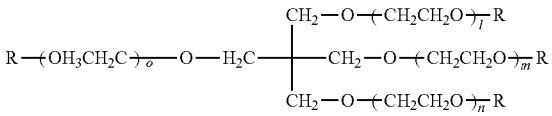

(7)

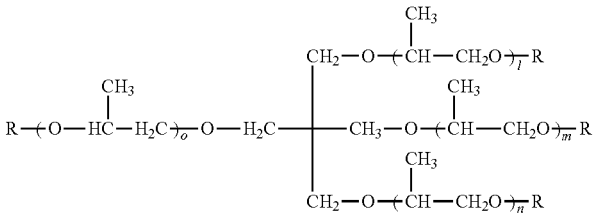

(8)

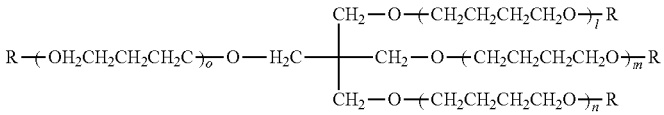

-continued
(9)
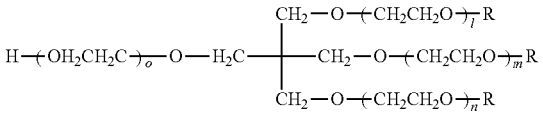
(10)
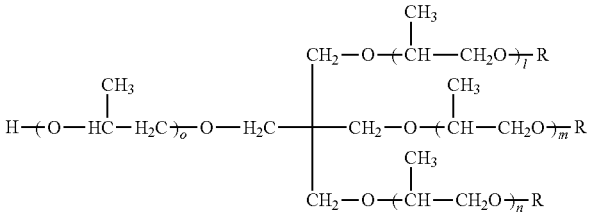
(11)
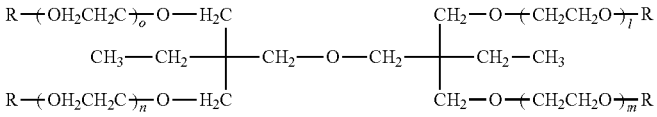
(12)
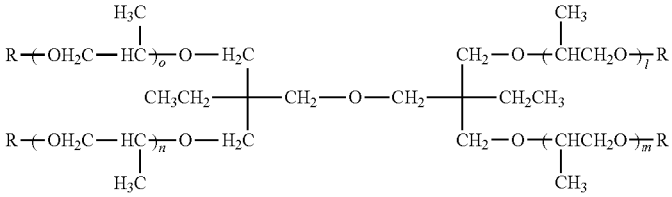
With regard to the compound represented by the chemical formulae (6) to (12), l, m, n, and o are an integer of 0 or more, and $1 \leq l+m+n+o \leq 40$. Furthermore, in the compound, a=l+m+n+o, and b=4.
(13)
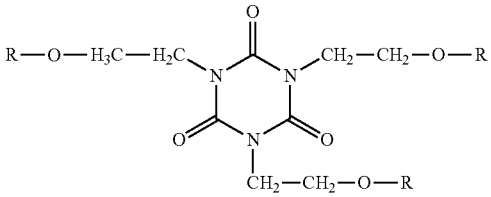
(14)
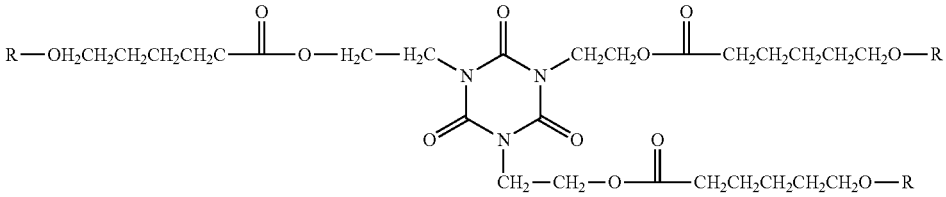
With regard to the compound represented by the chemical formula (13), a=3 and b=3. Furthermore, with regard to the compound represented by the chemical formula (14), a=6 and b=3.
(15)
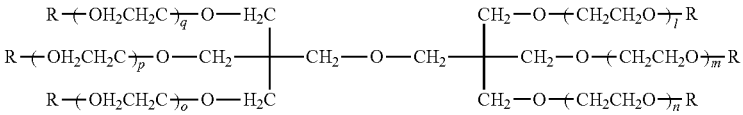

-continued (16)

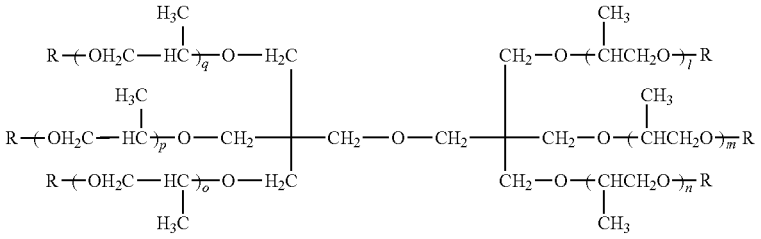

(17)

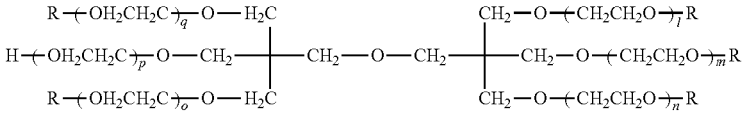

(18)

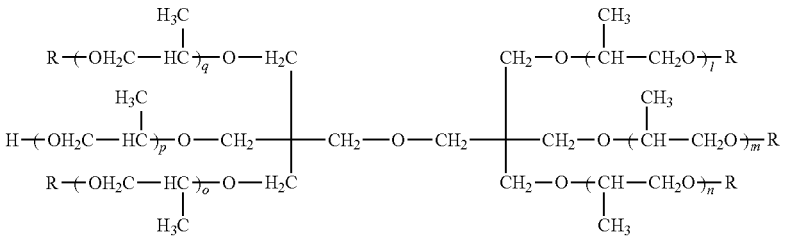

With regard to the compound represented by the chemical formulae (15) to (18), l, m, n, o, p, and q are an integer of 0 or more, and $1 \leq l+m+n+o+p+q \leq 60$. Furthermore, in the compound, a=l+m+n+o+p+q, and b=6.

(19)

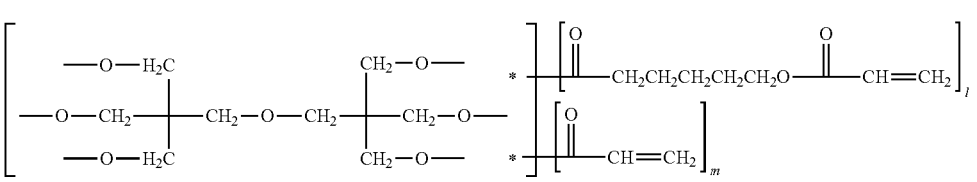

With regard to the compound represented by the chemical formula (19), l and m are an integer of 1 or more, and $2 \leq l+m \leq 6$. Furthermore, in the compound, a=l and b=l+m.

Additional specific examples of the polyfunctional (meth) acrylic monomer represented by the above chemical formulae include ethoxylated (12) dipentaerythritol hexa(meth) acrylate (a/b=2, b=6), caprolactone modified (6) dipentaerythritol hexa(meth)acrylate (a/b=1, b=6), ethoxylated (3) trimethylolpropane tri(meth)acrylate (a/b=1, b=3), ethoxylated (8) pentaerythritol tetra(meth)acrylate (a/b=2, b=4), ethoxylated (35) pentaerythritol tetra(meth)acrylate (a/b=8.75, b=4), and ethoxylated (15) pentaerythritol tetra (meth)acrylate (a/b=5, b=3).

Incidentally, the number described in the parenthesis of each chemical compound represents the number a of the alkylene oxide structure. For example, ethoxylated (12) dipentaerythritol hexa(meth)acrylate indicates that it has 12 alkylene oxide structures. Furthermore, caprolactone modified (6) dipentaerythritol hexa(meth)acrylate indicates that it has 6 alkylene oxide structures.

As for the polyfunctional (meth)acrylic monomer, it may be synthesized or a commercially available product may be used. Examples of the commercially available product include DPEA-12, DPCA-60, and TPE-330 (manufactured by Nippon Kayaku Co., Ltd.); M-DPH-12E and ATM-8EL (manufactured by SHIN-NAKAMURA CHEMICAL CO., LTD.); TM-35E (manufactured by SHIN-NAKAMURA CHEMICAL CO., LTD.); and SR9035 (manufactured by Sartomer).

(Fine Particle of Metal Oxide)

The fine particle of metal oxide according to the present invention has on its surface a structure represented by the following General Formula (1):

$$CH_2{=}C(R)COO(CH_2)_nSi{-} \qquad \text{General Formula (1)}$$

In the formula, R represents a hydrogen atom or a methyl group, and n is an integer of from 7 to 17.

According to a preferred embodiment of the present invention, n in the above General Formula (1) is from 7 to 14, preferably from 7 to 13, and more preferably from 8 to 13 from the viewpoint of further enhancing the cleaning property and transfer function.

The fine particle of metal oxide according to the present invention can be obtained by treating fine particle containing metal oxide with a surface treatment agent which has a structure of the above General Formula (1). According to the treatment, the fine particle of metal oxide is given on its surface with a reactive group having an unsaturated bond, and thus it can bind to other fine particle of metal oxide or the polyfunctional (meth)acrylic monomer.

Examples of a material of the fine particle of metal oxide include a fine particle containing at least one metal oxide selected from a group consisting of silica (silicon oxide), magnesium oxide, zinc oxide, lead oxide, aluminum oxide (alumina), tantalum oxide, indium oxide, bismuth oxide, yttrium oxide, cobalt oxide, copper oxide, manganese oxide, selenium oxide, iron oxide, zirconium oxide, germanium oxide, tin oxide, titania (titanium oxide), niobium oxide, molybdenum oxide, and vanadium oxide. The material of the fine particle of metal oxide is preferably a fine particle containing at least one metal oxide selected from a group consisting of tin oxide and alumina.

As for the surface treatment agent, it is not particularly limited as long as it is a silane compound which can provide a material of the fine particle of metal oxide with the structure of the above General Formula (1). Specific examples of the surface treatment agent include a compound of the following General Formula (2):

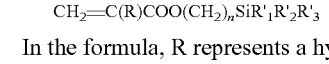

$$CH_2{=}C(R)COO(CH_2)_nSiR'_1R'_2R'_3 \qquad \text{General Formula (2)}$$

In the formula, R represents a hydrogen atom or a methyl group, n is an integer of from 7 to 17, and $R'_1$, $R'_2$ and $R'_3$ is each independently selected from $CH_3$, $OCH_3$, $OC_2H_5$, and Cl. Incidentally, all of $R'_1$, $R'_2$ and $R'_3$ may be identical to one another.

Specific examples of the surface treatment agent include 7-(meth)acryloxyheptyl trimethoxysilane, 8-(meth)acryloxyoctyl trimethoxysilane, 9-(meth)acryloxynonyl trimethoxysilane, 10-(meth)acryloxydecyl trimethoxysilane, 11-(meth)acryloxyundecyl trimethoxysilane, 12-(meth) acryloxydodecyl trimethoxysilane, 13-(meth)acryloxytridecyl trimethoxysilane, 14-(meth)acryloxytetradecyl trimethoxysilane, 15-(meth)acryloxypentadecyl trimethoxysilane, 16-(meth)acryloxyhexadecyl trimethoxysilane, and 17-(meth)acryloxyheptadecyl trimethoxysilane.

The method for producing a surface treatment agent is not particularly limited, and it can be produced by suitably modifying a conventionally known production method, for example, the production method described in Japanese Patent Application Laid-Open No. H5-306290.

The addition amount of the fine particle of metal oxide in the composition is, relative to 100 parts by volume of the polyfunctional (meth)acrylic monomer, preferably from 10 to 60 parts by volume, and more preferably from 20 to 50 parts by volume.

The number average primary particle diameter of the fine particle of metal oxide is from 1 to 300 nm, for example. It is preferably from 3 to 100 nm, and more preferably from 10 to 50 nm.

The number average primary particle diameter of the fine particle of metal oxide can be calculated by taking a 10000-times magnified photograph with a scanning electron microscope (manufactured by JEOL Ltd.), which has randomly taken for 300 particles with a scanner, and subjecting the photograph image (with aggregated particles being excluded) to the automatic image processing analyzer "LUZEX AP" (manufactured by Nireco Corporation) software version Ver. 1.32.

(Solvent)

Examples of the solvent include methanol, ethanol, n-propyl alcohol, isopropyl alcohol, n-butanol, t-butanol, sec-butanol, benzyl alcohol, toluene, xylene, methylene chloride, methyl ethyl ketone, methyl isobutyl ketone, cyclohexane, ethyl acetate, butyl acetate, methyl cellosolve, ethyl cellosolve, tetrahydrofuran, 1-dioxane, 1,3-dioxolan, pyridine, and diethylamine. The solvent may be used either singly or in combination of 2 or more types.

The addition amount of the solvent in the composition can be suitably adjusted from the viewpoint of enhancing dissolution or even dispersion of the polyfunctional (meth) acrylic monomer and fine particle of metal oxide, and also the coating property at the time of forming a surface layer.

(Polymerization Initiator)

As for the polymerization initiator, any one of a photopolymerization initiator and a thermal polymerization initiator can be used by the method of curing a composition containing the polyfunctional (meth)acrylic monomer and fine particle of metal oxide. Furthermore, it is also possible to use a photopolymerization initiator and a thermal polymerization initiator in combination.

Examples of the photopolymerization initiator include a carbonyl compound such as benzoin, benzoin methyl ether, benzoin ethyl ether, benzoin isopropyl ether, benzoin isobutyl ether, acetoin, butyloin, toluoin, benzil, benzophenone, p-methoxybenzophenone, diethoxyacetophenone, 2,2-dimethoxy-2-phenylacetophenone, methyl phenyl glyoxylate, ethyl phenyl glyoxylate, 4,4-bis(dimethylaminobenzophenone), 2-hydroxy-2-methyl-1-phenylpropan-1-one, 1-hydroxycyclohexyl phenyl ketone, or 1-(4-isopropylphenyl)2-hydroxy-2-methylpropan-1-one; a sulfur compound such as tetramethylthiuram disulfide or tetramethylthiuram disulfide; an azo compound such as azobisisobutyronitrile or azobis-2,4-dimethylvaleronitrile; a peroxide compound such as benzoyl peroxide or ditertiary butyl peroxide; and a phosphine oxide compound such as 2,4,6-trimethyl benzoyl diphenyl phosphine oxide.

Examples of the thermal polymerization initiator include dicumyl peroxide, di-t-butyl peroxide, t-butyl peroxybenzoate, t-butyl hydroperoxide, benzoyl peroxide, cumene hydroperoxide, diisopropyl benzene hydroperoxide, paramenthane hydroperoxide, and di-t-butyl peroxide.

The addition amount of the polymerization initiator is, although not particularly limited, preferably from 0.1 to 10% by mass, and more preferably from 0.1 to 5% by mass relative to the total amount of the composition.

(Method for Preparing Fine Particle of Metal Oxide)

Hereinbelow, the method for preparing a fine particle of metal oxide according to the present invention is explained.

The method for surface treatment of a fine particle containing metal oxide is not particularly limited, and a known method can be used. For example, it is preferable that, at the time of a surface treatment, from 0.1 to 200 parts by volume of a surface treatment agent and from 50 to 5000 parts by volume of a solvent be used relative to 100 parts by volume of the particle, and the treatment is carried out by using a wet medium dispersion type apparatus. The treatment can be also carried out in a dry mode. Hereinbelow, the method for surface treatment for preparing the fine particle of metal oxide of which surface is treated evenly with a surface treatment agent is explained.

According to wet pulverization of slurry (a suspension of solid particles) containing the fine particle of metal oxide and a surface treatment agent, the fine particle containing metal oxide is micronized and simultaneously a surface treatment of the fine particle containing metal oxide proceeds. Thereafter, according to removal of the solvent and obtaining a product in powder form, the fine particle of metal oxide of which surface is evenly treated with a surface treatment agent can be obtained.

The wet medium dispersion type apparatus as a surface treatment apparatus is an apparatus which has a step of crushing and dispersing by filling a vessel with beads as medium and rotating a stirring disc attached perpendicularly to a rotation shaft at a high speed to crush aggregated particle of the fine particle of metal oxide. As for the constitution of the apparatus, there is no particular problem so long as the apparatus can sufficiently disperse the fine particle of metal oxide during surface treatment of the fine particle of metal oxide and can achieve the surface treatment. For example, various types such as a vertical•horizontal type and a continuous•batch-wise type can be adopted. Specifically, a sand mill, an Ultra Visco mill, a pearl mill, a grain mill, a dyno mill, an agitator mill, or a dynamic mill can be employed. Such a dispersion type apparatus carries out fine crushing and dispersion by using a crushing medium such as balls and beads based on impact collapse, friction, shear, or shear stress.

Balls made of a source material such as glass, alumina, zircon, zirconia, steel, or flint can be used as beads used in the above wet medium dispersion type apparatus, and particularly, balls made of zirconia or zircon are preferred. Furthermore, as for the size of the beads, those having a diameter approximately from 1 to 2 mm are generally used, and the beads having a size approximately from 0.1 to 1.0 mm are preferably employed in the present invention.

Various materials such as stainless steel, nylon, and ceramics can be used for a disc or an inner wall of a vessel used in a wet medium dispersion type apparatus, and in particular, a disc or an inner wall made of ceramics such as zirconia or silicon carbide is particularly preferable in the present invention.

[Method for Producing Intermediate Transfer Member]

Hereinbelow, by having the intermediate transfer belt which is a preferred embodiment of the intermediate transfer member of the present invention as an example, a preferred method for producing an intermediate transfer member is explained.

Figure 2:
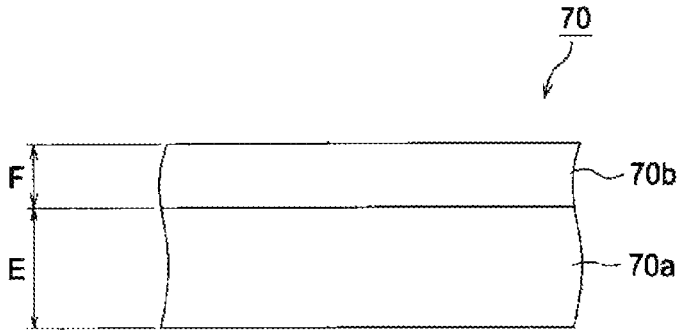
FIG. 2 is a diagram illustrating a partially enlarged cross-sectional structure of an intermediate transfer member according to one embodiment of the present invention.
Figure 3A:
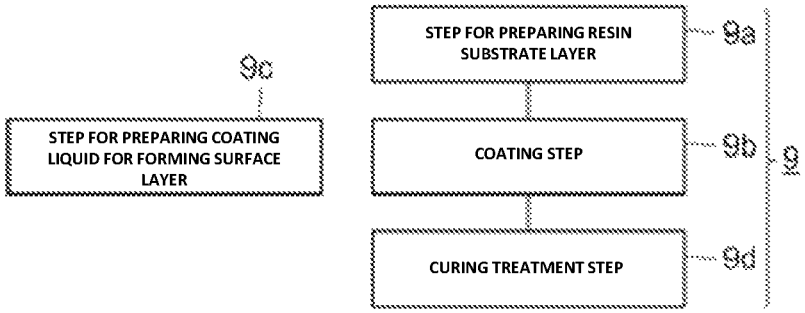
FIG. 3A illustrates a flow for producing an intermediate transfer member according to one embodiment of the present invention.
Figure 3B:
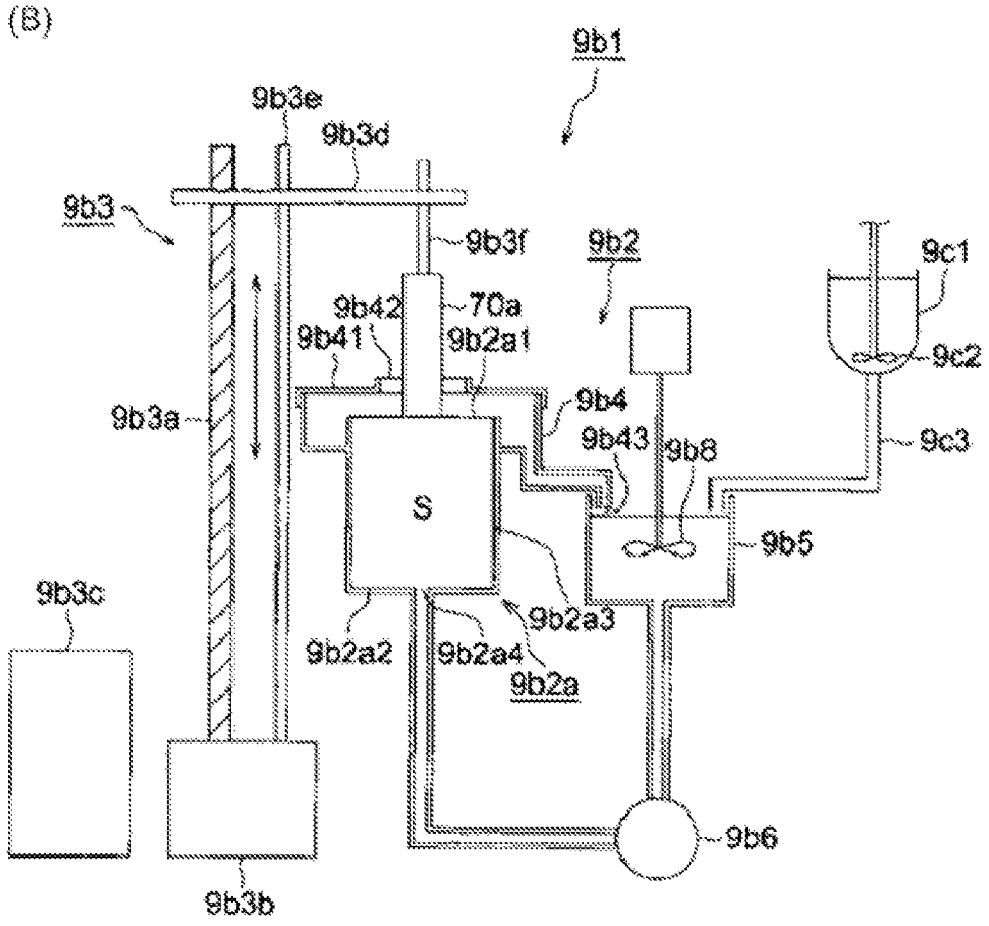
FIG. 3B is a diagram schematically illustrating a coating apparatus used therefor.

FIG. 3A is a diagram of a schematic flow of producing the intermediate transfer belt illustrated in FIG. 2. FIG. 3B is a schematic diagram illustrating an example of a dip coating apparatus that applies a coating liquid for forming a surface layer to a surface of a resin substrate layer used in the coating step illustrated in FIG. 3A.

Production process 9 for intermediate transfer belt 70 includes resin substrate layer producing step 9*a* for producing a ring shaped endless belt as a resin substrate layer, surface layer-forming coating liquid preparation step 9*c* for preparing a coating liquid for forming a surface layer, coating step 9*b* for applying a coating liquid for forming a surface layer to a surface of the produced ring shaped endless belt (resin substrate layer), and curing treatment step 9*d* for curing the coating film formed during the surface layer-forming coating liquid preparation step.

In resin substrate layer producing step 9*a*, a ring shaped endless belt (resin substrate layer) 70*a* illustrated in FIG. 2 is produced by a conventionally known common production method. For example, a mixture containing a resin as a raw material and a conductive filler is melted through an extruder and formed into a cylindrical shape by the inflation technique using a ring shaped die, and the resulting cylindrical product is cut horizontally into round slices, whereby a resin substrate layer as a ring shaped endless belt can be produced.

The cylindrical product can also be obtained by, for example, drying a ring-like coating film of a mixture of a polyamide acid and a conductive filler so as to have a belt-like shape and heating the resulting formed product to imidize the polyamide acid and collecting the resulting product (see, for example, Japanese Patent Application Laid-Open Nos. S61-95361, $64-22514, and H3-180309). Examples of methods for forming a ring-like coating film include the following methods in which; a polyamide acid solution is applied to the outer peripheral surface of a cylindrical mold; the solution is applied to the inner peripheral surface of a cylindrical mold; centrifugal force is applied to the coating film of the solution on the inner peripheral surface of a cylindrical mold; and the solution is charged into a casting mold.

For the production of a ring shaped endless belt (rein base layer), any proper treatments such as mold releasing treatment and defoaming treatment may be performed. The ring shaped endless belt (resin substrate layer) 70*a* according to the present invention has conductivity.

Surface layer-forming coating liquid preparation step 9*c* can be performed by using surface layer-forming coating liquid preparation container 9*c*1, stirrer 9*c*2, and liquid feed pipe 9*c*3 that feeds a prepared coating liquid for forming a surface layer to coating liquid supply tank 9*b*5 of dip coating apparatus 9*b*1. The coating liquid for forming a surface layer prepared in surface layer-forming coating liquid preparation step 9*c* is a composition which contains the polyfunctional (meth)acrylic monomer and fine particle of metal oxide that are described above.

Coating step 9*b* can be performed using dip coating apparatus 9*b*1. Dip coating apparatus 9*b*1 includes coating section 9*b*2 and supply section 9*b*3 for a resin substrate layer for an intermediate transfer belt. Coating section 9*b*2 includes coating bath 9*b*2*a*, overflown solution receiving bath 9*b*4 disposed at an upper portion of coating bath 9*b*2*a*, in which overflown solution receiving bath 9*b*4 is to receive a coating liquid for forming a surface layer overflown from opening portion 9*b*2*a*1 of coating bath 9*b*2*a*, coating liquid supply tank 9*b*5, and liquid feed pump 9*b*6. S denotes a coating liquid for forming a surface layer.

Coating bath 9*b*2*a* includes bottom portion 9*b*2*a*2 and side wall 9*b*2*a*3 erected from a periphery of bottom portion 9*b*2*a*2, and the upper portion of coating bath 9*b*2*a* corresponds to opening portion 9*b*2*a*1. Coating bath 9*b*2*a* has a cylindrical shape. Opening portion 9*b*2*a*1 and bottom portion 9*b*2*a*2 have the same diameter. 9*b*2*a*4 denotes a coating liquid supply port provided at bottom portion 9*b*2*a*2 of coating bath 9*b*2*a*. Surface layer-forming coating liquid S is fed from liquid feed pump 9*b*6 to coating bath 9*b*2*a* via coating liquid supply port 9*b*2*a*4.

9*b*41 denotes a lid of overflown solution receiving bath 9*b*4. Lid 9*b*41 includes hole 9*b*42 at a center thereof. 9*b*43 denotes coating liquid return port that returns a coating liquid S for forming a surface layer in overflown solution receiving bath 9*b*4 to coating liquid supply tank 9*b*5. 9*b*8 denotes a blade for stirring which is provided in coating liquid supply tank 9*b*5.

Supply section 9*b*3 includes ball screw 9*b*3*a*, drive section 9*b*3*b* that rotates ball screw 9*b*3*a*, control section 9*b*3*c* that controls a rotation speed of ball screw 9*b*3*a*, lifting member 9*b*3*d* connected by screws to ball screw 9*b*3*a*, and guide member 9*b*3*e* that moves lifting member 9*b*3*d* in vertical directions (directions indicated by the arrow in the Figure) along with rotation of ball screw 9*b*3*a*. 9*b*3*f* denotes a holding member that holds ring shaped endless belt (resin substrate layer) 70*a*, the holding member being attached to lifting member 9*b*3*d*. Here, ring shaped endless belt (resin substrate layer) 70*a* is held on a surface of cylindrical or columnar member 203 (see FIG. 4A) adjusted to a diameter of ring shape endless belt (resin substrate layer) 70*a*. Holding member 9*b*3*f* is attached to lifting member 9*b*3*d* in such a manner that held ring shaped endless belt (resin substrate layer) 70*a* is positioned approximately at a center of coating bath 9*b*2*a*.

Ring shaped endless belt (resin substrate layer) 70*a* is held by holding member 9*b*3*f* attached to lifting member 9*b*3*d*. Along with rotation of ball screw 9*b*3*a*, lifting member 9*b*3*d* moves in up and down direction. Consequently, ring shaped endless belt (resin substrate layer) 70*a* held by holding member 9*b*3*f* is dipped in coating liquid S for forming a surface layer in coating bath 9*b*2*a* and then is lifted up. Consequently, coating liquid S for forming a surface layer is applied to a surface of ring shaped endless belt (resin substrate layer) 70*a*, and thus a coating film is formed.

It is necessary to suitably change a speed for lifting up ring shaped endless belt (resin substrate layer) 70*a* as appropriate according to the viscosity of coating liquid S for forming a surface layer to be used. For example, if the viscosity of coating liquid S for forming a surface layer is from 10 to 200 mPa·s, the speed for lifting ring shaped endless belt (resin substrate layer) 70*a* up is preferably from 0.5 to 15 mm/sec in consideration of coating evenness, coating film thickness, drying or the like.

In order to efficiently carry out a curing reaction by an active energy ray, the coating film may be heated and dried before curing the coating film. The heating method is not particularly limited, but examples of the heating method include hot-air blowing. The heating temperature cannot generally be determined due to the type of the polyfunctional (meth)acrylic monomer to be used, but preferably, falls within a range of temperatures that do not affect the coating film. The heating temperature is preferably from 40 to 100° C., more preferably from 40 to 80° C., and particularly preferably from 40 to 60° C.

Incidentally, for application of coating liquid S for forming a surface layer to the surface of ring shaped endless belt (resin substrate layer) 70*a* in the present invention, any of other known methods can be employed. Examples of the other methods include ring shaped coating methods using a ring-shaped coating bath, spray coating methods and coating method using an ultrasonic atomizer.

Figure 4A:
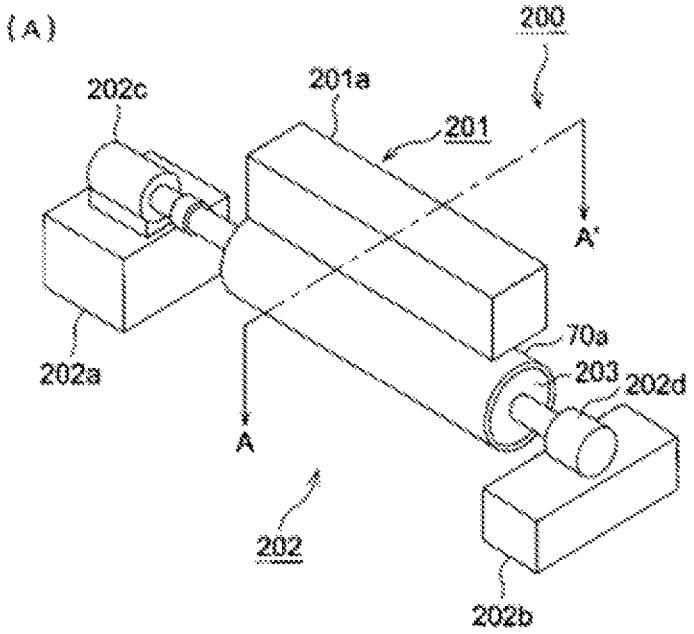
FIGS. 4A and 4B are diagrams schematically illustrating a curing treatment apparatus which is used for the curing treatment step for production of an intermediate transfer member according to one embodiment of the present invention.
Figure 4B:
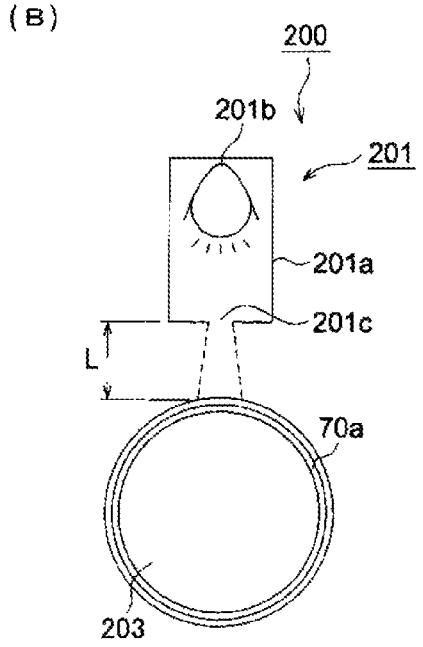

Curing treatment step 9*d* can be performed using curing apparatus 200 illustrated in FIGS. 4A and 4B.

FIGS. 4A and 4B are schematic diagrams illustrating an example of a curing apparatus for a surface layer, which is used in the curing treatment step illustrated in FIG. 3A. FIG. 4A is a perspective diagram schematically illustrating an example of a curing apparatus for a surface layer, which is used in the curing treatment step illustrated in FIG. 3A. FIG. 4B is a diagram illustrating a cross-section of the curing apparatus along line A-A' of FIG. 4A.

Curing apparatus 200 includes active energy ray irradiation apparatus 201, cylindrical or columnar member 203 that holds ring shaped endless belt (resin substrate layer) 70*a* with a coating film for forming a surface layer on a surface thereof, and holding device 202 that holds cylindrical or columnar member 203 such that cylindrical or columnar member 203 can freely rotate.

Active energy ray irradiation apparatus 201 is fixed to a frame (not illustrated) of curing apparatus 200. Active energy ray irradiation apparatus 201 is disposed at a position facing cylindrical or columnar member 203 so as to irradiate cylindrical or columnar member 203 with an active energy ray. Active energy ray irradiation apparatus 201 includes casing 201*a*, active energy ray source 201*b* housed in casing 201*a*, and energy control device (not illustrated) for active energy irradiation source 201*b*.

201*c* denotes a port for active energy ray irradiation, which is provided at a bottom portion of casing 201*a* (face facing the surface of ring shaped endless belt (resin substrate layer) 70*a*). L denotes a distance from irradiation port 201*c* to the surface of ring shaped endless belt (resin substrate layer) 70*a*. Distance L can arbitrarily be set according to the intensity of the active energy ray and/or the type of curing components in the coating film, or the like. According to a preferred embodiment of the present invention, the distance L is from 10 to 200 mm.

Holding device 202 includes first holding table 202*a*, second holding table 202*b*, drive motor 202*c*, and bearing portion 202*d*. Drive motor 202*c* is arranged and disposed on the top of first holding table 202*a*, and bearing portion 202*d* is arranged and disposed on the top of second holding table 202*b*.

Cylindrical or columnar member 203 is connected to a rotating shaft of motor 202*c* via one attachment shaft of cylindrical or columnar member 203 and a connection member. Also, cylindrical or columnar member 203 is connected to bearing portion 202*d* via another attachment shaft of cylindrical or columnar member 203. Consequently, cylindrical or columnar member 203 is held in such a manner that, driven by motor 202*c*, cylindrical or columnar member 203 can rotate.

Upon driving of drive motor 202*c*, cylindrical or columnar member 203 rotates. Then, cylindrical or columnar member 203 is irradiated with an active energy ray using active energy ray irradiation apparatus 201. Consequently, the coating film on the surface of ring shaped endless belt (resin substrate layer) 70*a* cures, whereby surface layer 70*b* is formed.

The rotation speed (circumferential velocity) of cylindrical or columnar member 203 when cylindrical or columnar member 203 is irradiated with an active energy ray is preferably from 10 to 300 mm/s in consideration of curing unevenness, hardness, curing time, or the like.

Examples of an active energy ray include ultraviolet ray, electron beam, and γ-ray. It is preferably ultraviolet ray or electron beam. Among them, the active energy ray is preferably ultraviolet ray from the viewpoint of a simple handling property and easy obtainment of high energy.

For a light source for ultraviolet ray, any light source that generates ultraviolet ray can be used. For example, LED, a low pressure mercury lamp, a medium pressure mercury lamp, a high pressure mercury lamp, an ultrahigh pressure mercury lamp, a carbon arc lamp, a metal halide lamp, a xenon lamp may be used. Also, an ArF excimer laser, a KrF excimer laser, an excimer lamp, a synchrotron radiation, or the like may be used. In order to irradiate with a spot-like active energy ray, it is preferable to use an ultraviolet laser.

For an electron beam, an electron beam having energy of from 50 to 1000 keV, preferably from 100 to 300 keV, which is emitted from an electron beam accelerators of any of various types such as the Cockcroft-Walton type, the Van de Graaf type, the resonance transformation type, the insulated core transformer type, the linear type, the Dynamitron type and the radio-frequency type can be mentioned.

Irradiation conditions for active energy ray may vary depending on the respective light sources. For example, an irradiating light quantity of ultraviolet ray is preferably from 0.5 to 10 J/cm$^2$, more preferably from 1 to 6 J/cm$^2$, and particularly preferably from 1 to 4 J/cm$^2$ in consideration of curing unevenness, hardness, curing time, curing speed or the like. Incidentally, the irradiating light quantity indicates a value measured by UIT250 (manufactured by Ushio Inc.).

Irradiance of active energy ray can be suitably controlled. The irradiance is from 40 to 200 mW/cm$^2$, for example. It is preferably from 60 to 200 mW/cm$^2$, and more preferably from 100 to 200 mW/cm$^2$. Furthermore, the irradiation time of active energy can be suitably controlled so as to have desire irradiance.

For an atmosphere during active energy ray irradiation, it is not particularly limited, and the irradiation can be performed in an air atmosphere, nitrogen atmosphere, or inert gas atmosphere. The oxygen concentration in the atmosphere is preferably 5% by volume or less, particularly preferably 1% by volume or less in consideration of curing unevenness or curing time. In order to have the oxygen concentration in the atmosphere to be within such range, it is effective to introduce nitrogen gas or the like. According to a preferred embodiment of the present invention, ultraviolet irradiation is carried out in a nitrogen atmosphere. The oxygen concentration can be measured by an OX100 oxygen analyzer for monitoring ambient gases (manufactured by Yokogawa Electric Corporation).

In the form illustrated in FIGS. 4A and 4B, cylindrical or columnar member 203 is irradiated with an active energy ray while cylindrical or columnar member 203 is rotated with fixed irradiation apparatus 201; however, it is possible that cylindrical or columnar member 203 be fixed and active energy ray irradiation apparatus 201 moves along a periphery of cylindrical or columnar member 203. Also, in the form illustrated in FIGS. 4A and 4B, cylindrical or columnar member 203 is horizontally arranged. However, it is also possible that cylindrical or columnar member 203 be vertically arranged.

<Image Forming Apparatus>

According to the other embodiment of the present invention, an image forming apparatus having the above intermediate transfer member is provided.

The intermediate transfer member of the present invention is desirably used for an image forming apparatus by which a toner image supported on an electrostatic latent image support is firstly transferred to an intermediate transfer member, and then the toner image is secondly transferred from the intermediate transfer member to a recording medium, for example, an image forming method and an image forming apparatus including a copying machine, a printer, a facsimile or the like of electrophotography type.

Hereinbelow, the image forming device in which the intermediate transfer member of the present invention can be used as an intermediate belt is explained by having a color image forming apparatus as an example.

Full color image forming apparatus 1 shown in FIG. 1 has casing 8 which can be drawn from main body A of the apparatus through supporting rails 82L, 82R, plural sets of image forming units 10Y, 10M, 10C and 10K, endless belt shaped intermediate transfer unit 7 as a transfer section, endless belt shaped sheet feeding conveyance means 21 that conveys recording member P, and belt type fixing device 24 as a fixing means. On the upper part of main body A of the full color image forming apparatus 1, there is arranged document image reading device SC.

Casing 8 has image forming units 10Y, 10M, 10C and 10K, and endless belt shaped intermediate transfer member unit 7. According to a drawing operation of the casing 8, image forming units 10Y, 10M, 10C, and 10K and endless belt shaped intermediate transfer member unit 7 are integrated into one body and drawn from main body A.

Image forming units 10Y, 10M, 10C and 10K are arranged in one row in the vertical direction. Image forming units 10Y, 10M, 10C, and 10K have the same structure except that the color of the toner received therein is different. Y represents yellow, M represents magenta, C represents cyan, and K represent black. For example, image forming unit 10Y has drum shaped photosensitive member 1Y, charging means 2Y arranged around photosensitive member 1Y, exposure means 3Y, developing means 4Y, cleaning means 6Y, and means 11Y for coating fatty acid metal salt on photosensitive member 1Y. The fatty acid metal salt is the same as the fatty acid metal salt contained in a toner, for example.

On the left side of photosensitive members 1Y, 1M, 1C, and 1K on a paper surface of FIG. 1, there is arranged endless belt shaped intermediate transfer unit 7. Endless belt shaped intermediate transfer unit 7 possesses endless belt shaped intermediate transfer member 70 which is installed such that it can rotate with an aid of rollers 71, 72, 73, 74, 76, and 77, primary transfer rollers 5Y, 5M, 5C, and 5K to transfer the toner image supported on photosensitive members 1Y, 1M, 1C, and 1K to intermediate transfer belt 70, and cleaning means 6A. Intermediate transfer belt 70 corresponds to the intermediate transfer member of the present invention. The cleaning member of cleaning means 6A is an elastic blade.

As illustrated in FIG. 2, intermediate transfer belt 70 has a constitution in which surface layer 70*b* is provided on the top of endless belt shaped resin substrate layer 70*a*. The constitution of surface layer 70*b* is not particularly limited and thus, surface layer 70*b* may consist of one layer or two layers. In the figure, a case in which the surface layer 70*b* consists of one layer is shown.

Thickness E of endless belt shaped resin substrate layer 70*a* is preferably from 30 to 140 μm in consideration of mechanical strength, image quality and producing costs.

Thickness F of surface layer 70*b* is preferably from 0.5 to 15 μm in consideration of transfer ratio, durability, filming and image quality. The thickness of the surface layer can be measured using a Fischer Scope (registered trademark) MMS manufactured by Fischer Instruments.

In full color image forming apparatus 1, first, toner images of respective colors are formed by respective image forming units 10Y, 10M, 10C and 10K. Outer peripheral surfaces of photosensitive members 1Y, 1M, 1C, and 1K are charged and exposed to light, whereby latent images are formed on the respective outer peripheral surfaces. Subsequently, toner images (visible images) are formed on the outer peripheral surfaces in accordance with development.

The toner images of the respective colors formed by image forming units 10Y, 10M, 10C and 10K are sequentially transferred onto rotating intermediate transfer belt 70 by primary transfer rollers 5Y, 5M, 5C and 5K. Consequently, a color toner image resulting from superimposition of the toner images of the respective colors is formed on intermediate transfer belt 70.

The color toner image on intermediate transfer belt 70 is transferred onto recording medium (transfer material) P. Recording medium P such as a sheet loaded in sheet feeding cassette 20 is fed by sheet feeding section 21 and conveyed to secondary transfer roller 5A via a plurality of intermediate rollers 22A, 22B, 22C and 22D and registration roller 23. Then, the color toner image on intermediate transfer belt 70 is transferred onto recording medium P by secondary transfer roller 5A.

The color toner image transferred on recording medium P is fixed to recording medium P by pressure and heat applied using belt type fixing unit 24 equipped with heat roller fixing device 270. Recording medium P with the color toner image fixed thereto is sandwiched by sheet discharging roller 25 and outputted on sheet discharging tray 26.

Toners remaining on respective photosensitive members 1Y, 1M, 1C, and 1K after the transfer of the toner image of the respective colors onto intermediate transfer belt 70 are removed by respective cleaning means 6Y, 6M, 6C and 6K. Subsequently, upon entry into the above cycle of charging, exposure and development, next image forming is carried out. Toner remaining on intermediate transfer belt 70 is removed by cleaning means 6A.

[Transfer Material]

A transfer material used in the present invention is a support that holds a toner image which is commonly called an image support, a transfer material or a transfer sheet. Preferably, there are given plain paper including thin paper up to thick paper, coated printing paper such as art paper and coated paper, Japanese paper and postcard paper which are on the market, plastic film for OHP and various types of transfer materials such as cloth or the like, but the present invention is not limited thereto.

Incidentally, the intermediate transfer member of the present invention can be also used as a thermal fixing belt other than the intermediate transfer belt described above.

EXAMPLES

The present invention is described specifically by using the following examples and comparative examples. However, it is evident that the technical scope of the present invention is not limited to the following examples. Incidentally, unless specifically described otherwise, "%" and "parts" mean "% by mass" and "parts by mass", respectively. Furthermore, unless specifically described otherwise, the operations in the following examples were performed at conditions of room temperature (25° C.)/relative humidity of from 40 to 50% RH.

[Preparation of Resin Substrate Layer]

(Preparation of Resin Substrate Layer 1)

A resin substrate layer for an intermediate transfer member was prepared in accordance with a method below.

In a monoaxial extruder, 100 parts by mass of a polyphenylene sulfide (PPS) resin (E2180 manufactured by Toray Industries, Inc.), 16 parts by mass of carbon black (Furnace #3030B manufactured by Mitsubishi Chemical Corporation), 1 part by mass of an ethylene glycidyl methacrylate-acrylonitrile styrene copolymer (MODIPER A4400 manufactured by NOF Corporation), and 0.2 part by mass of calcium montanate were introduced, molten, and mixed and kneaded to obtain a resin mixture. Subsequently, a ring type die having an outlet like a slit and in a shape of a seamless belt was attached to a tip end of the monoaxial extruder, and the mixed and kneaded resin mixture was extruded into a shape of the seamless belt. Then, the extruded resin mixture in the shape of the seamless belt was placed on the outside of a cooling cylinder provided at a discharge end, and cooled to solidify. Thus, resin substrate layer 1 in a shape of a seamless cylinder having a thickness of 120 μm was prepared.

(Resin Base Layer 2)

To polyamideimide (PAI) resin (VYLOMAX (registered trade mark) HR16NN; manufactured by TOYOBO CO., LTD.), dried carbon black after oxidation treatment (SPECIAL BLACK4; manufactured by Degussa, pH 3.0, volatile component: 14.0%) was added such that it is 23 parts by mass relative to 100 parts by mass of the resin solid content, and a composition was prepared. After dividing the composition into 2 parts, by using a collision type disperser "Geanus PY" (manufactured by Geanus), the composition was collided at a pressure of 200 MPa and a minimum area of 1.4 $mm^2$. Thereafter, the composition was allowed to pass through a passage of being divided into two again five times to be mixed. Thus, a carbon black-containing polyamideimide resin solution was obtained. The inner circumference surface of a cylindrical mold was coated with the obtained carbon black-containing polyamideimide resin solution via a dispenser to a thickness of 0.5 mm, and was rotated at 1500 rpm for 15 minutes to obtain a developing layer having a uniform thickness. Thereafter, the mold was blown with hot air from the outside of the mold at 60° C. for 30 minutes while being rotated at 250 rpm, and then heated at 150° C. for 60 minutes. Thereafter, the temperature was increased to 250° C. at a temperature increase rate of 2° C./minute, and heating was further performed at 250° C. for 60 minutes. Thereafter, the temperature was returned to room temperature, and peeling from the mold was carried out to prepare seamless cylindrical resin substrate layer 2 having a thickness of 120 μm.

(Resin Base Layer 3)

Resin base layer 3 was prepared in the same manner as resin substrate layer 1 except that, instead of polyphenylene sulfide (PPS) resin, polyether ether ketone (PEEK) resin (VICTREX (registered trade mark) PEEK381G; manufactured by VICTREX) was used.

(Resin Base Layer 4)

To an N-methyl-2-pyrrolidone (NMP) solution of a polyamide acid consisting of 3,3',4,4'-biphenyltetracarboxylic acid dianhydride (BPDA) and p-phenylene diamine (PDA) (U Varnish S; manufactured by Ube Industries, Ltd, solid content: 18% by mass), a dried carbon black after oxidation treatment (SPECIAL BLACK 4; manufactured by Degussa, pH 3.0, volatile component: 14.0%) was added such that it is 23 parts by mass relative to 100 parts by mass of the polyimide-based resin solid content to prepare a composition. After dividing the composition into 2 parts, by using a collision type disperser "Geanus PY" (manufactured by Geanus), the composition was collided at a pressure of 200 MPa and a minimum area of 1.4 $mm^2$. Thereafter, the composition was allowed to pass through a passage of being divided into two again five times to be mixed. Thus, a carbon black-containing polyamide acid solution was obtained. The inner circumference surface of a cylindrical mold was coated with the obtained carbon black-containing polyamide acid solution via a dispenser to a thickness of 0.5 mm, and was rotated at 1500 rpm for 15 minutes to obtain a developing layer having a uniform thickness. Thereafter, the mold was blown with hot air from the outside of the mold at 60° C. for 30 minutes while being rotated at 250 rpm, and then heated at 150° C. for 60 minutes. Thereafter, the temperature was increased to 360° C. at a temperature increase rate of 2° C. minute, and heating was further performed at 360° C. for 30 minutes. Thus, removal of the solvent, removal of dehydration ring-closing water, and completion of an imide conversion reaction were achieved. Thereafter, the temperature was returned to room temperature, and peeling from the mold was carried out to prepare seamless cylindrical resin substrate layer 4 having a thickness of 120 μm.

[Preparation of Rine Particle of Metal Oxide]

(Preparation of Fine Particle of Metal Oxide 1)

100 parts by volume of fine particle of tin oxide with number average PRIMARY PARTICLE DIAMETER OF 34 NM (NANOTEK (REGISTERED TRADE MARK) $SNO_2$; manufactured by CIK Nanotek) were admixed with 15 parts by volume of 8-methacryloxyoctyl trimethoxysilane (KBM-5803; manufactured by Shin-Etsu Chemical Co., Ltd.) and 400 parts by volume of a solvent (toluene:isopropyl alcohol=1:1) followed by dispersing them with a wet medium dispersion type apparatus. After removing the solvent and drying for 30 minutes at 150° C., surface treated fine particle of metal oxide 1 was obtained.

(Preparation of Fine Particle of Metal Oxide 2)

Fine particle of metal oxide 2 was prepared in the same manner as fine particle of metal oxide 1 except that 10-methacryloxyoctyl trimethoxysilane was used instead of 8-methacryloxyoctyl trimethoxysilane.

(Preparation of Fine Particle of Metal Oxide 3)

Fine particle of metal oxide 3 was prepared in the same manner as fine particle of metal oxide 1 except that 12-methacryloxyoctyl trimethoxysilane was used instead of 8-methacryloxyoctyl trimethoxysilane.

(Preparation of Fine Particle of Metal Oxide 4)

Fine particle of metal oxide 4 was prepared in the same manner as fine particle of metal oxide 1 except that 14-methacryloxyoctyl trimethoxysilane was used instead of 8-methacryloxyoctyl trimethoxysilane.

(Preparation of Fine Particle of Metal Oxide 5)

Fine particle of metal oxide 5 was prepared in the same manner as fine particle of metal oxide 1 except that fine particle of alumina with number average primary particle diameter of 30 nm (Nanotek (registered trade mark) $Al_2O_3$; manufactured by CIK Nanotek) was used instead of fine particle of tin oxide.

(Preparation of Fine Particle of Metal Oxide 6)

Fine particle of metal oxide 6 was prepared in the same manner as fine particle of metal oxide 2 except that fine particle of alumina with number average primary particle diameter of 30 nm (Nanotek (registered trade mark) $Al_2O_3$; manufactured by CIK Nanotek) was used instead of fine particle of tin oxide.

(Preparation of Fine Particle of Metal Oxide 7)

Fine particle of metal oxide 7 was prepared in the same manner as fine particle of metal oxide 1 except that 3-methacryloxypropyl trimethoxysilane (KBM-503; manufactured by Shin-Etsu Chemical Co., Ltd.) was used instead of 8-methacryloxyoctyl trimethoxysilane.

(Preparation of Fine Particle of Metal Oxide 8)

Fine particle of metal oxide 8 was prepared in the same manner as fine particle of metal oxide 1 except that 18-methacryloxyoctyl trimethoxysilane was used instead of 8-methacryloxyoctyl trimethoxysilane.

(Preparation of Fine Particle of Metal Oxide 9)

Fine particle of metal oxide 9 was prepared in the same manner as fine particle of metal oxide 1 except that 7-octenyltrimethoxysilane (KBM-1083; manufactured by Shin-Etsu Chemical Co., Ltd.) was used instead of 8-methacryloxyoctyl trimethoxysilane.

(Preparation of Fine Particle of Metal Oxide 10)

Fine particle of metal oxide 10 was prepared in the same manner as fine particle of metal oxide 1 except that 8-glycidoxyoctyl trimethoxysilane (KBM-4803; manufactured by Shin-Etsu Chemical Co., Ltd.) was used instead of 8-methacryloxyoctyl trimethoxysilane.

[Production of Intermediate Transfer Member 1]

(Preparation of Coating Liquid 1 for Forming Surface Layer)

75 parts by volume of ethoxylated (12) dipentaerythritol hexaacrylate (ethoxylated (12) DPHA) (DPEA-12; manufactured by Nippon Kayaku Co., Ltd.) and 25 parts by volume of fine particle of metal oxide 1 were dissolved and dispersed in methyl isobutyl ketone (MIBK) such that the solid content concentration was 20% by volume to prepare a diluted solution. 100 parts by mass of the diluted solution was admixed with 0.1 part by mass of a photopolymerization initiator (IRGACURE (registered trade mark) 810; manufactured by BASF Japan) to prepare coating liquid 1 for forming surface layer, which was a composition containing the polyfunctional (meth)acrylic monomer and fine particle of metal oxide.

(Forming of Surface Layer)

On an outer circumferential surface of resin substrate layer 1 which was prepared in the above, a coating film was formed by coating of coating liquid 1 for forming surface layer to have dry film thickness of 4 μm by a dip coating method which used the coating device shown in FIGS. 4A and 4B. By irradiating the coating film with ultraviolet ray as active energy ray at the following irradiation conditions, a surface layer was formed in accordance with curing the coating film and the intermediate transfer member 1 was produced. Incidentally, the irradiation of ultraviolet ray onto the coating film was carried out while fixing the light source and rotating at circumferential rate of 60 mm/s the resin substrate layer with formed coating film on the outer circumferential surface.

Conditions for Coating

Supply amount of coating liquid: 1 L/min

Lift up speed: 10 mm/sec.

Conditions for Ultraviolet Ray Irradiation

Type of light source: 365 nm LED light source (SPX-TA; manufactured by REVOX Inc.)

Distance from irradiation port to surface of coating film: 100 mm

Atmosphere: nitrogen

Irradiation light quantity: 1 J/cm$^2$

Irradiance: 150 mW/cm$^2$

Irradiation time (time for rotating resin substrate layer): 240 seconds.

[Production of Intermediate Transfer Member 2]

Intermediate transfer member 2 was produced in the same manner as intermediate transfer member 1 except that the following coating liquid 2 for forming surface layer was used instead of coating liquid 1 for forming surface layer.

(Preparation of Coating Liquid 2 for Forming Surface Layer)

Coating liquid 2 for forming surface layer was prepared in the same manner as coating liquid 1 for forming surface layer except that fine particle of metal oxide 2 was used instead of fine particle of metal oxide 1.

[Production of Intermediate Transfer Member 3]

Intermediate transfer member 3 was produced in the same manner as intermediate transfer member 1 except that the following coating liquid 3 for forming surface layer was used instead of coating liquid 1 for forming surface layer.

(Preparation of Coating Liquid 3 for Forming Surface Layer)

Coating liquid 3 for forming surface layer was prepared in the same manner as coating liquid 1 for forming surface layer except that fine particle of metal oxide 3 was used instead of fine particle of metal oxide 1.

[Production of Intermediate Transfer Member 4]

Intermediate transfer member 4 was produced in the same manner as intermediate transfer member 1 except that the following coating liquid 4 for forming surface layer was used instead of coating liquid 1 for forming surface layer.

(Preparation of Coating Liquid 4 for Forming Surface Layer)

Coating liquid 4 for forming surface layer was prepared in the same manner as coating liquid 1 for forming surface layer except that fine particle of metal oxide 4 was used instead of fine particle of metal oxide 1.

[Production of Intermediate Transfer Member 5]

Intermediate transfer member 5 was produced in the same manner as intermediate transfer member 1 except that the following coating liquid 5 for forming surface layer was used instead of coating liquid 1 for forming surface layer, and resin substrate layer 2 was used instead of resin substrate layer 1.

(Preparation of Coating Liquid 5 for Forming Surface Layer)

Coating liquid 5 for forming surface layer was prepared in the same manner as coating liquid 1 for forming surface layer except that ethoxylated (12) DPHA was set at 70 parts by volume and the fine particle of metal oxide 1 was set at 30 parts by volume.

[Production of Intermediate Transfer Member 6]

Intermediate transfer member 6 was produced in the same manner as intermediate transfer member 1 except that the following coating liquid 6 for forming surface layer was used instead of coating liquid 1 for forming surface layer.

(Preparation of Coating Liquid 6 for Forming Surface Layer)

Coating liquid 6 for forming surface layer was prepared in the same manner as coating liquid 1 for forming surface layer except that ethoxylated (12) DPHA was set at 80 parts by volume and the fine particle of metal oxide 1 was set at 20 parts by volume.

[Production of Intermediate Transfer Member 7]

Intermediate transfer member 7 was produced in the same manner as intermediate transfer member 2 except that ethoxylated (12) dipentaerythritol hexamethacrylate (ethoxylated (12) DPHMA) (M-DPH-12E; manufactured by SHIN-NAKAMURA CHEMICAL CO., LTD.) was used instead of ethoxylated (12) DPHA.

[Production of Intermediate Transfer Member 8]

Intermediate transfer member 8 was produced in the same manner as intermediate transfer member 1 except that the following coating liquid 7 for forming surface layer was used instead of coating liquid 1 for forming surface layer, and resin substrate layer 3 was used instead of resin substrate layer 1.

(Preparation of Coating Liquid 7 for Forming Surface Layer)

Coating liquid 7 for forming surface layer was prepared in the same manner as coating liquid 1 for forming surface layer except that ethoxylated (3) trimethylolproapne triacrylate (ethoxylated (3)TMPTA) (TPE-330; manufactured by Nippon Kayaku Co., Ltd.) was used instead of ethoxylated (12) DPHA and the fine particle of metal oxide 5 was used instead of fine particle of metal oxide 1.

[Production of Intermediate Transfer Member 9]

Intermediate transfer member 9 was produced in the same manner as intermediate transfer member 2 except that ethoxylated (8) pentaerythritol tetraacrylate (ethoxylated (8) PETTA) (ATM-8EL; manufactured by SHIN-NAKAMURA CHEMICAL CO., LTD.) was used instead of ethoxylated (12) DPHA.

[Production of Intermediate Transfer Member 10]

Intermediate transfer member 10 was produced in the same manner as intermediate transfer member 1 except that caprolactone modified (6) DPHA (DPCA-60; manufactured by Nippon Kayaku Co., Ltd.) was used instead of ethoxylated (12) DPHA.

[Production of Intermediate Transfer Member 11]

Intermediate transfer member 11 was produced in the same manner as intermediate transfer member 1 except that the following coating liquid 8 for forming surface layer was used instead of coating liquid 1 for forming surface layer, and resin substrate layer 4 was used instead of resin substrate layer 1.

(Preparation of Coating Liquid 8 for Forming Surface Layer)

Coating liquid 8 for forming surface layer was prepared in the same manner as coating liquid 1 for forming surface layer except that fine particle of metal oxide 6 was used instead of fine particle of metal oxide 1.

[Production of Intermediate Transfer Member 12]

Intermediate transfer member 12 was produced in the same manner as intermediate transfer member 1 except that ethoxylated (35) PETTA (TM-35E; manufactured by SHIN-NAKAMURA CHEMICAL CO., LTD.) was used instead of ethoxylated (12) DPHA.

[Production of Intermediate Transfer Member 13]

Intermediate transfer member 13 was produced in the same manner as intermediate transfer member 1 except that ethoxylated (15) trimethylolproapne triacrylate (ethoxylated (15)TMPTA) (SR9035; manufactured by Sartomer) was used instead of ethoxylated (12) DPHA.

[Production of Intermediate Transfer Member 14]

Intermediate transfer member 14 was produced in the same manner as intermediate transfer member 1 except that fine particle of metal oxide 7 was used instead of fine particle of metal oxide 1.

[Production of Intermediate Transfer Member 15]

Intermediate transfer member 15 was produced in the same manner as intermediate transfer member 1 except that fine particle of metal oxide 8 was used instead of fine particle of metal oxide 1.

[Production of Intermediate Transfer Member 16]

Intermediate transfer member 16 was produced in the same manner as intermediate transfer member 1 except that fine particle of metal oxide 9 was used instead of fine particle of metal oxide 1.

[Production of Intermediate Transfer Member 17]

Intermediate transfer member 17 was produced in the same manner as intermediate transfer member 1 except that fine particle of metal oxide 10 was used instead of fine particle of metal oxide 1.

[Production of Intermediate Transfer Member 18]

Intermediate transfer member 18 was produced in the same manner as intermediate transfer member 1 except that the following coating liquid 9 for forming surface layer was used instead of coating liquid 1 for forming surface layer.

(Preparation of Coating Liquid 9 for Forming Surface Layer)

Coating liquid 9 for forming surface layer was prepared in the same manner as coating liquid 1 for forming surface layer except that 50 parts by volume of dipentaerythritol hexaacrylate (DPHA) (DPHA; manufactured by Nippon Kayaku Co., Ltd.) and 25 parts by volume of polyethylene glycol (PEG) diacrylate (A-400; manufactured by SHIN-NAKAMURA CHEMICAL CO., LTD.) were used instead of 75 parts by volume of ethoxylated (12) DPHA.

[Production of Intermediate Transfer Member 19]

Intermediate transfer member 19 was produced in the same manner as intermediate transfer member 1 except that the following coating liquid 10 for forming surface layer was used instead of coating liquid 1 for forming surface layer.

(Preparation of Coating Liquid 10 for Forming Surface Layer)

Coating liquid 10 for forming surface layer was prepared in the same manner as coating liquid 1 for forming surface layer except that 100 parts by volume of DPHA were used instead of 75 parts by volume of ethoxylated (12) DPHA and 25 parts by volume of fine particle of metal oxide 1.

Constitution and production conditions of intermediate transfer members 1 to 19 which have been produced in the above are shown in the following Table 1.

TABLE 1

| | | Surface layer | | | | | | | | | |
|---|---|---|---|---|---|---|---|---|---|---|---|
| | | Fine particle of metal oxide | | | Polyfunctional (meth)acrylate monomer | | | | | | |
| Intermediate transfer member No. | Resin substrate layer Resin | No. | n | Addition amount (parts by volume) | Compound | a | b | a/b | Addition amount (parts by volume) | Functional group equivalent weight | |
| 1 | PPS | 1 | 8 | 25 | Ethoxylated (12) DPHA | 12 | 6 | 2 | 75 | 184 | Example |
| 2 | PPS | 2 | 10 | 25 | Ethoxylated (12) DPHA | 12 | 6 | 2 | 75 | 184 | |
| 3 | PPS | 3 | 12 | 25 | Ethoxylated (12) DPHA | 12 | 6 | 2 | 75 | 184 | |
| 4 | PPS | 4 | 14 | 25 | Ethoxylated (12) DPHA | 12 | 6 | 2 | 75 | 184 | |
| 5 | PAI | 1 | 8 | 30 | Ethoxylated (12) DPHA | 12 | 6 | 2 | 70 | 184 | |
| 6 | PPS | 1 | 8 | 20 | Ethoxylated (12) DPHA | 12 | 6 | 2 | 80 | 184 | |
| 7 | PPS | 2 | 10 | 25 | Ethoxylated (12) DPHMA | 12 | 6 | 2 | 75 | 198 | |
| 8 | PEEK | 5 | 8 | 25 | Ethoxylated (3) TMPTA | 3 | 3 | 1 | 75 | 142 | |
| 9 | PPS | 2 | 10 | 25 | Ethoxylated (8) PETTA | 8 | 4 | 2 | 75 | 176 | |
| 10 | PPS | 1 | 8 | 25 | Caprolactone modified (6) DPHA | 6 | 6 | 1 | 75 | 210 | |
| 11 | PI | 6 | 10 | 25 | Ethoxylated (12) DPHA | 6 | 6 | 1 | 75 | 184 | |
| 12 | PPS | 1 | 8 | 25 | Ethoxylated (35) PETTA | 35 | 4 | 8.75 | 75 | 473 | |
| 13 | PPS | 1 | 8 | 25 | Ethoxylated (15) TMPTA | 15 | 3 | 5 | 75 | 318 | |
| 14 | PPS | 7 | 3 | 25 | Ethoxylated (12) DPHA | 12 | 6 | 2 | 75 | 184 | Comparative |
| 15 | PPS | 8 | 18 | 25 | Ethoxylated (12) DPHA | 12 | 6 | 2 | 75 | 184 | Example |
| 16 | PPS | 9 | 6 | 25 | Ethoxylated (12) DPHA | 12 | 6 | 2 | 75 | 184 | |
| 17 | PPS | 10 | 8 | 25 | Ethoxylated (12) DPHA | 12 | 6 | 2 | 75 | 184 | |
| 18 | PPS | 1 | 8 | 25 | DPHA | 1 | 6 | 0.17 | 50 | 244 | |
| | | | | | PEG diacrylate | 9 | 2 | 4.5 | 25 | | |
| 19 | PPS | — | — | — | DPHA | 1 | 6 | 0.17 | 100 | 96 | |

<Performance Evaluation of Intermediate Transfer Member>

For intermediate transfer members 1 to 19 produced above, the following evaluations were performed.

(1) Crack Resistance Test

The crack resistance test was carried out on the basis of JIS P8115:2001. For the crack resistance test, the load was 250 gf, and a clamp with R of 0.38 μm was used. Furthermore, the test rate was 175 cpm, and the bending angle was 90°. The evaluation criteria are as described below, and when the evaluations results are "⊙", "○" and "Δ", it was determined to be usable.

Evaluation Criteria

⊙: MIT value is 1000 times or more

○: MIT value is 500 times or more but less than 1000 times

Δ: MIT value is 100 times or more but less than 500 times x: MIT value is less than 100 times (2) Evaluation of Cleaning Property As an evaluation device for evaluating a cleaning property, a full color image forming device (manufactured by Konica Minolta Business Technologies, bizhub C554 (tandem color comples machine of laser exposure, reversal development, and intermediate transfer member) to which intermediate transfer members 1 to 21 can be mounted was prepared as shown in FIG. 1. Furthermore, after mounting each intermediate transfer member to the evaluation device, the cleaning property was evaluated after a durability test.

More specifically, the durability test in which an image with a coverage rate of 2.5% for each of respective colors, yellow (Y), magenta (M), cyan (C) and black (Bk) at 20° C. and 50% RH was printed on 600,000 sheets of neutralized paper, was conducted. After the durability test, 100 sheets of an image with coverage rate of 100% (solid image) for cyan (C) were printed, and then an image with coverage rate of 100% (solid image) for yellow (Y) was printed. The evaluations were made according to the following criteria.

The evaluation criteria are as described below, and when the evaluations results are "⊙", "○" and "Δ", it was determined to be usable.

Evaluation Criteria

⊙: Streaky dirt derived from a cleaning defect did not occur at all on a printed image.

○: Streaky dirt derived from a cleaning defect occurred on a printed image, but it was lost after printing of 10 sheets.

Δ: Streaky dirt derived from a cleaning defect occurred slightly on a printed image.

x: Streaky dirt derived from a cleaning defect occurred clearly on a printed image.

(3) Evaluation of Transfer Ratio

As an evaluation device for evaluating transfer ratio, a full color image forming device (manufactured by Konica Minolta Inc., bizhub (registered trade mark) PRESS C8000) to which intermediate transfer members 1 to 21 can be mounted was prepared as shown in FIG. 1. Furthermore, after mounting each intermediate transfer member to the evaluation device, the transfer ratio was obtained before and after the aforementioned durability test.

More specifically, the durability test in which an image with a coverage rate of 2.5% for each of respective colors, yellow (Y), magenta (M), cyan (C) and black (Bk) at 20° C. and 50% RH was printed on 600,000 sheets of neutralized paper, was conducted. For each of the initial stage of the durability test and after the durability test, the weight A (g) of the toner on the intermediate transfer member before secondary transfer and weight B (g) of the transfer remaining toner on the intermediate transfer member after secondary transfer were measured, and then the toner transfer ratio (%) was obtained based on the following Equation 1. The weight A was obtained from the result of collecting, by using an aspiration device, the toner on a region with a predetermined area of a surface of the intermediate transfer member (three regions with 10 mm×50 mm) between after primary transfer and before secondary transfer. The weight B is obtained by collecting the transfer remaining toner on the intermediate transfer member after secondary transfer using a Booker tape, adhering the Booker tape with a white sheet, measuring color of the white sheet using a spectrophotometer (CM-2002, manufactured by Konica Minolta Sensing. Inc.), and determining the relationship between the toner weight which has been measured in advance and the measured color value. The evaluation criteria are as described below, and when the evaluations results are "⊙", "○" and "Δ", it was determined to be usable.

$$\text{Transfer ratio (\%)}=\{1-(B/A)\}\times 100 \qquad \text{Equation 1}$$

Evaluation Criteria

⊙: Transfer ratio is 98% or more

○: Transfer ratio is 95% or more but less than 98%

Δ: Transfer ratio is 90% or more but less than 95% x: Transfer ratio is less than 90%.

TABLE 2

| Intermediate transfer member No. | Crack resistance | Cleaning property | Transfer ratio | |
|---|---|---|---|---|
| 1 | ○ | ⊙ | ⊙ | Example |
| 2 | ○ | ○ | ○ | |
| 3 | ⊙ | Δ | ○ | |
| 4 | ⊙ | Δ | Δ | |
| 5 | ○ | ⊙ | ⊙ | |
| 6 | ○ | ⊙ | ○ | |
| 7 | ○ | ○ | ⊙ | |
| 8 | ○ | ○ | ○ | |
| 9 | ⊙ | ⊙ | ⊙ | |
| 10 | ⊙ | ⊙ | ○ | |
| 11 | ○ | ○ | ○ | |
| 12 | ⊙ | Δ | Δ | |
| 13 | ○ | Δ | Δ | |
| 14 | X | Not operable due to cracks | | Comparative Example |
| 15 | ⊙ | X | X | |
| 16 | ○ | X | X | |
| 17 | ○ | X | X | |
| 18 | Δ | X | X | |
| 19 | X | Not operable due to cracks | | |

As it is evident from the results shown in Table 2, it was found that the intermediate transfer member of Examples can suppress an occurrence of cracks and improve the cleaning property and transfer function of a toner when compared to Comparative Examples.

What is claimed is:

1. An intermediate transfer member used for an electrophotographic image forming apparatus, wherein the intermediate transfer member has a resin substrate layer and a surface layer comprising a cured product of a composition containing a polyfunctional (meth)acrylic monomer and a fine particle of metal oxide, the polyfunctional (meth)acrylic monomer comprises a number of alkylene oxide structure (a) and a number of (meth)acryloyl group (b) (with the proviso that a and b are a positive integer), a and b satisfy relationships of a/b≤10 and b≥3, the alkylene oxide structure comprises an alkylene group with a carbon atom number of 2 or more, and the fine particle of metal oxide has been surface-treated by a surface treatment agent having a structure represented by General Formula (2):

$$CH_2{=}C(R)COO(CH_2)_nSiR'_1R'_2R'_3$$

wherein,

R represents a hydrogen atom or a methyl group, n is an integer of from 7 to 17, and $R'_1$, $R'_2$ and $R'_3$ are each independently selected from $CH_3$, $OCH_3$, $OC_2H_5$, and Cl, and $R'_1$, $R'_2$ and $R'_3$ may be same or different.

2. The intermediate transfer member according to claim 1, wherein functional group equivalent weight of the polyfunctional (meth)acrylic monomer is 130 or more and 250 or less.

3. The intermediate transfer member according to claim 1, wherein a and b satisfy relationship of a/b≤3.

4. The intermediate transfer member according to claim 1, wherein the carbon atom number of the alkylene group is 2 to 5.

5. The intermediate transfer member according to claim 1, wherein n in the General Formula (2) is 7 to 13.

6. The intermediate transfer member according to claim 1, wherein the resin substrate layer comprises a resin having a structural unit containing a benzene ring.

7. The intermediate transfer member according to claim 6, wherein the resin is polyphenylene sulfide.

8. An image forming apparatus having the intermediate transfer member according to claim 1.

* * * * *